US005423440A

United States Patent [19]

Castaneda et al.

[11] Patent Number: 5,423,440

[45] Date of Patent: Jun. 13, 1995

[54] AMPULE FOR CHEMICAL OXYGEN DEMAND TEST

[75] Inventors: Henry B. Castaneda, Woodbridge; G. Neil Spokes, Marshall; Gordon A. Rampy, Warrenton, all of Va.

[73] Assignee: CHEMetrics, Inc., Calverton, Va.

[21] Appl. No.: 136,368

[22] Filed: Oct. 15, 1993

[51] Int. Cl.[6] ..... B65D 1/02

[52] U.S. Cl. ..... 215/49; 215/226; 215/295

[58] Field of Search ..... 215/31, 32, 226, 295

[56] References Cited

U.S. PATENT DOCUMENTS

| | | | |
|---|---|---|---|
| 1,224,231 | 5/1917 | Sumich . | |
| 2,517,604 | 8/1948 | Smith . | |
| 3,085,705 | 9/1960 | Varney . | |
| 3,459,185 | 8/1969 | Bender et al. . | |
| 3,544,020 | 12/1970 | Goldberg et al. | 215/32 X |
| 3,688,812 | 9/1972 | Fredericks . | |
| 3,720,341 | 3/1973 | Greenfield et al. | 215/32 X |
| 3,749,271 | 7/1973 | Ellis, Jr. et al. | 215/32 |
| 4,134,511 | 1/1979 | Deussen . | |
| 4,196,820 | 4/1980 | Lipowski et al. . | |
| 4,254,883 | 3/1981 | Urban . | |
| 4,266,681 | 5/1981 | Fredericks | 215/32 |
| 4,353,869 | 10/1982 | Guth | 215/32 X |
| 4,379,647 | 4/1983 | Kempf . | |
| 4,481,297 | 11/1984 | Zucal et al. . | |
| 4,559,052 | 12/1985 | Babson . | |
| 4,826,025 | 5/1989 | Abiko et al. | 215/32 |
| 4,884,707 | 12/1989 | Crisci . | |

FOREIGN PATENT DOCUMENTS

| | | | |
|---|---|---|---|
| 617018 | 3/1961 | Canada . | |
| 2209292 | 6/1974 | France | 215/32 |
| 2006712 | 5/1979 | United Kingdom | 215/32 |

*Primary Examiner*—Jes F. Pascua

*Attorney, Agent, or Firm*—Dickinson, Wright, Moon, Van Dusen & Freeman

[57] ABSTRACT

An article particularly useful for Chemical Oxygen Demand (COD) tests includes an ampule, a resealing cap, and a protective sheath. The ampule includes a segment along its neck that is detachable for allowing introduction of a sample. The cap is used for resealing the neck after introduction of a sample, and the detachable segment is located at a narrow diameter portion of the neck so that the expulsion force on the cap generated by interior pressure is small. A flexible sheath is provided to protect the neck during shipment and to assist in removing the detachable segment.

18 Claims, 1 Drawing Sheet

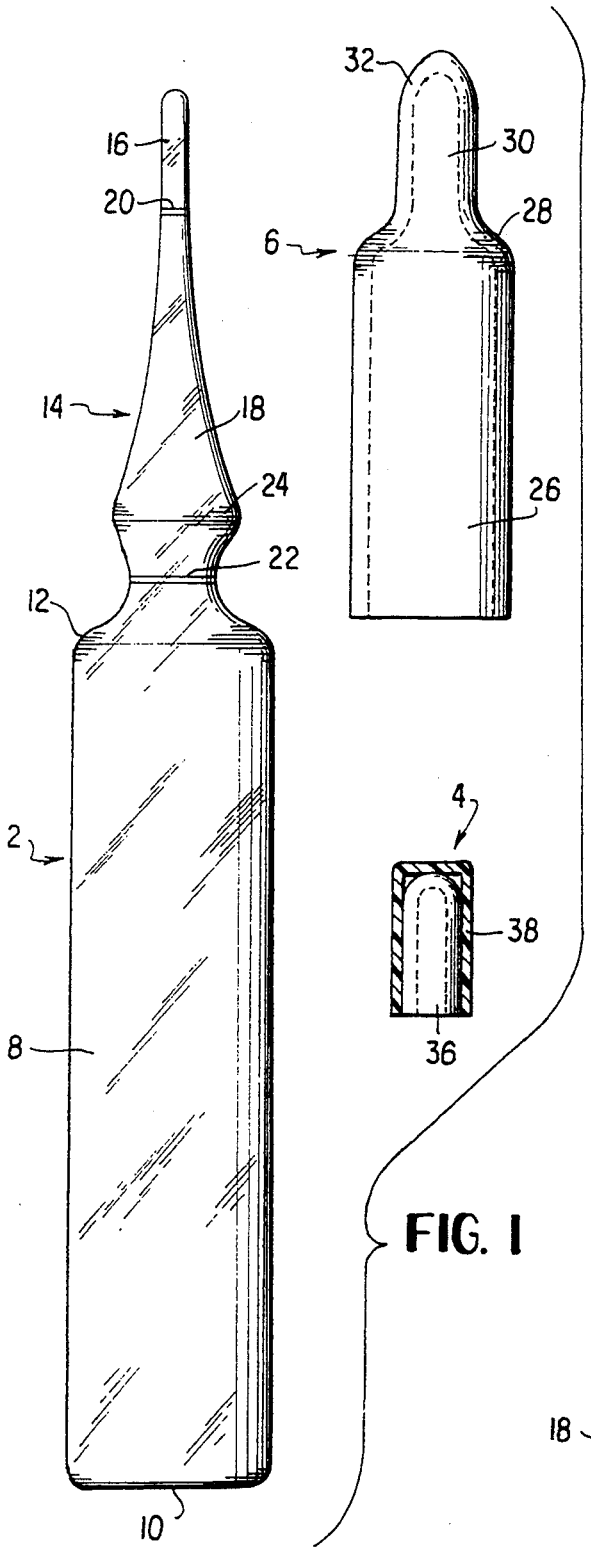
FIG. 1
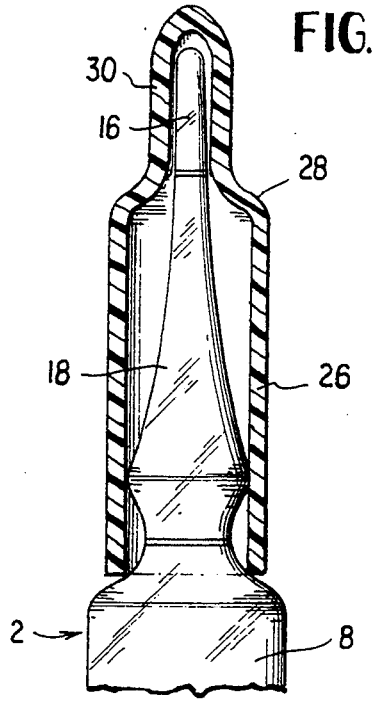
FIG. 2
FIG. 3
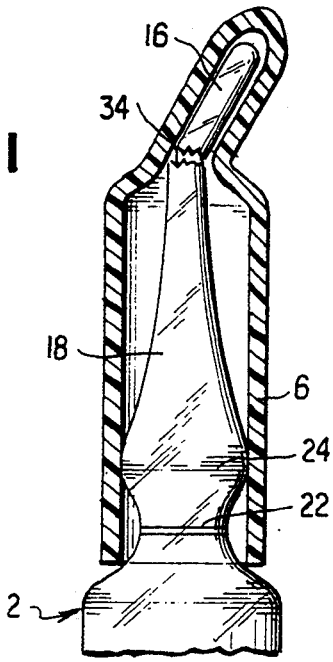
FIG. 4
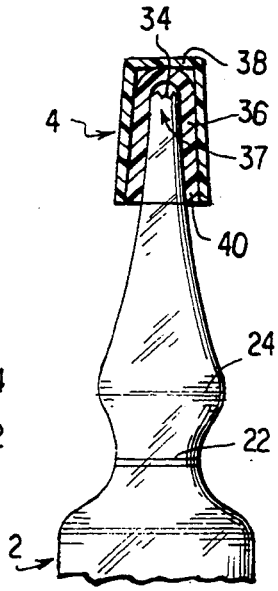

AMPULE FOR CHEMICAL OXYGEN DEMAND TEST

FIELD OF THE INVENTION

This invention relates to an improved ampule and to a combination including the improved ampule that is especially suitable for use in performing a Chemical Oxygen Demand (COD) test.

BACKGROUND OF THE INVENTION

A Chemical Oxygen Demand (COD) test is used to measure the oxygen equivalent of the organic matter in a sample that is susceptible to oxidation by a strong chemical oxidant. In the Open Reflux Method, the organic matter is oxidized by a boiling mixture of chromic and sulfuric acids. In a known method of performing the COD test a glass vial having premeasured reagents is supplied, and the sample is added to the glass vial. One known glass vial for use in a COD test is generally shaped like a test tube with a screw-on cap. The test tube is provided with reagents, and the sample to be tested is added to the reagents after removing the cap. The cap is replaced, and the reaction proceeds to completion in a heated digester block. The test tube is then placed in a spectrophotometer to complete the test.

Other glass vials of various types and other containers known in the prior art are shown in U.S. Pat. Nos. 4,559,052, 4,266,681, 3,688,812, 4,134,511, 4,481,297, 1,224,231, 2,517,604, 3,459,185, and 4,254,883. Similarly, many types of closures suitable for closing ampules or vials have been disclosed in the prior art. Some examples are provided by U.S. Pat. Nos. 3,085,705, 4,884,707, 4,379,647, 4,196,820, 4,481,297, and Can. 617,018.

The prior art vials/ampules present several disadvantages in at they are expensive to manufacture and difficult to use. For example, vials/ampules must be made of materials that do not interfere with the test. In the vial described above that uses a screw-on cap, the cap is lined with a Teflon coating to prevent reaction between the reagents and the material of the cap, which would interfere with the testing of the sample. And, the manufacture of the threaded neck requires thick glass, which is quite expensive.

SUMMARY OF THE INVENTION

In accordance with the invention, a unique ampule with a cap for resealing the ampule and a protective cover, or sheath, are provided. The ampule is particularly suitable for use in a Chemical Oxygen Demand (COD) laboratory test because it is inexpensively manufactured, easily shipped, and may be discarded after use. Reagents appropriate for the COD test are preferably placed in the ampule during manufacture.

The ampule of the invention includes a glass container portion (or vial) and a narrow, elongate neck that is flame sealed at the factory after introduction of the reagents. Because it is sealed at the factory, there is no loss of the reagents during shipping or storage. The tip of the neck includes at least one score mark to allow the tip to be easily snapped off to permit introduction of a sample to the container. The protective sheath may be used here to protect the fingers of the user.

After introduction of the sample, the neck is resealed by application of a small silicone cap. The provision of a narrow, tapered neck and the use of this small cap provide several advantages. One of these advantages is that the small opening in the neck is far less likely to result in spilling of the reagents, which are strong acids. Another important advantage is that the forces tending to dislodge the cap are much smaller because of the reduced area of the cap. The reagent vapors generated during the high temperature digestion and the reaction between the sample and the reagents, in addition to the permanent gases, create a significant gas pressure that tends to push the cap off of the neck during the digestion period. By reducing the area of application of these forces, the cap is easily held to the neck by the frictional forces between the sides of the neck and the sides of the cap. These frictional forces depend on the detailed interrelationship between the cap and tip dimensions and increase along the axis of the neck through the provision of an increasing diameter of the neck toward the container portion to stretch the cap.

Preferably, the cap comprises an inner sealing cap made of silicone and an outer sleeve of more rigid material. The inner cap is easily placed on the neck of the ampule, and the outer sleeve provides additional radial forces to retain the cap on the neck. The outer sleeve may be in the form of a cap, or it may be a spring or collar shaped device.

While the frictional forces are normally enough to secure the cap on the neck, there is the problem of thermal runaway of the digestion block that would produce a very high pressure in the container. The additional danger in such a situation is the possibility of explosion of the container, resulting in broken glass as well as spilled reagent. In this situation, the silicone cap will be forced off of the neck by the pressure to release it and prevent explosion of the glass container.

Another advantage of the narrow neck of the COD ampule is that the narrow neck restricts access of potentially reactive fluids and vapors from the main part of the container to the silicone rubber of the cap material during the digestion process. In this way, the ampule design automatically limits the amount of inadvertent, contaminating reaction.

Yet another advantage of the construction of the ampule of the invention is that the narrow neck tends to trap a segment of fluid near the top of the neck adjacent the cap during the digestion process. The presence of this fluid segment reduces the interaction between the reagents and the cap, thereby minimizing errors resulting from reaction between the cap itself and the reagents. Thus, a silicone cap can be used in a COD test even though that test is one for the presence of organic compounds.

The ampule of the invention is made of thin glass of optical quality to maintain accuracy in the spectrophotometric measurement. Preferably, the thickness of the glass is about 0.6 mm, which minimizes the errors traditionally associated with thicker walled ampules.

The ampule of the above-described combination may have at least two constrictions along its neck that are separated by at least one bulbous, convex portion. A second score mark is provided below the bulbous portion, between it and the container, to allow the remainder of the neck to be broken off as well. This, for example, provides an opening large enough to permit the contents of the container to be dispensed to another container for other tests. The sheath, which may be of a vinyl see-through material, may be used when breaking off the convex portion also.

BRIEF DESCRIPTION OF THE DRAWINGS

FIG. 1 is a side elevation view, drawn to scale, of a preferred embodiment of the present invention.

FIG. 2 is a side view of the neck of an ampule in accordance with the invention showing a sheath of the invention in cross section.

FIG. 3 is a view similar to FIG. 2 showing the tip of the ampule being snapped off.

FIG. 4 is a side view of the neck of an ampule in accordance with the invention having the tip removed and the neck resealed with a cap in accordance with the invention.

DETAILED DESCRIPTION OF THE PREFERRED EMBODIMENT

FIG. 1 is a side elevation view of a preferred embodiment of an ampule 2 in accordance with the present invention, a cap 4 for resealing the ampule, and a sheath 6 for protecting the ampule during shipping and facilitating the breaking open of the ampule.

Ampule 2 is preferably made of thin (e.g., 0.6 mm) optical quality glass and includes a container portion 8 having a bottom 10. The glass is preferably that known as white Type I borosilicate. The container is connected at shoulder 12 to an elongated neck portion 14. Neck 14 includes a first detachable segment 16 and a second detachable segment 18. Ceramic bands 20 and 22 facilitate detachment of the first and second detachable segments.

First detachable segment 16 extends from ceramic band 20 to the tip of the neck, while second detachable segment 18 extends from the second ceramic band 22 to the first ceramic band. Second ceramic band 22 is preferably located near the intersection of the neck 14 and the shoulder 12.

The neck 14 includes a single bulb formed by a convex portion 24 at the lower part of the second detachable segment 18 and just above ceramic band 22. The portion of the neck beyond the bulb is capable of being flame sealed after the reagents required for a particular chemical test, such as a COD test, have been added to the ampule. Additional bulbous portions may be provided, if desired.

Sheath 6 is preferably constructed from transparent plastic material, such as vinyl. The sheath fits over the neck of the ampule as shown in FIGS. 2 and 3 to protect the neck during storage and shipment and may include a hole (not illustrated) to allow air to escape when it is being slid over the neck. In use, the first detachable segment 16 is broken off by application of pressure as illustrated in FIG. 3. This is preferably accomplished with the sheath covering the neck, the transparency of the sheath allowing the user visually to locate the ceramic band and snap off the neck at the desired location. Use of the sheath in this manner protects the fingers of the user from engaging the contents of the container, should they be expelled from the ampule upon opening the container, and protects the fingers of the user from the possibility of being cut by the glass where the segment is detached. In addition, the sheath covering the neck is configured so as to contain the detachable segment 16 after it is broken off.

The sheath 6 comprises a cylindrical section 26, a conical section 28, and a nipple extension 30, all of which are in open communication with each other to allow the sheath to be placed over the neck as shown in FIGS. 2 and 3. The diameter of the nipple extension 30 is smaller than that of the cylindrical portion and terminates in a tip 32. The sheath is soft and resilient enough to protect the ampule during shipment.

After the segment 16 is detached, a sample to be tested is easily introduced into the ampule through the opening 34 (see FIGS. 3 and 4). Opening 34 is small, preferably having a diameter of about 1.7 mm. This small opening provides several advantages while still allowing a sample to be easily injected or otherwise introduced into the ampule.

An important advantage of the structure wherein the neck tapers to the small opening is the ability to reseal the ampule with the small cap 4, as illustrated in FIG. 4. The cap 4 is preferably made of silicone and fits tightly over the end of the neck after the segment 16 has been removed. The small diameter of the neck tip 37 is advantageous because the force exerted on the cap 4 by the internal pressure of the contents of the ampule is small even when the internal pressure is high. This is because the force exerted on the cap 4 is the product of the pressure created by the gases and the area of the neck tip 37, whose diameter is about 2.5 mm. This feature is particularly advantageous when the ampule is used in a COD test because the permanent gases, the reagent vapors, the gases released during the digestion process, and the expansion of those gases during the digestion process can lead to build up of considerable pressure inside the ampule.

The cap 4 preferably includes a sealing cap 36, made of silicone, and an outer sleeve 38, made of a more rigid plastic. The outer sleeve supplies a radial resistance to deformation of the silicone sealing cap to increase the radial force by the inner cap on the neck of the ampule. Thus, a significant engagement is provided between the skirt 40 of the inner cap and the neck to create a large frictional force for retaining the cap on the neck. The inner cap has a length of from about 10–20 mm and an internal diameter of just less than 2.5 mm. The neck of the ampule is tapered such that a gradual increase in the diameter of the neck, moving from the tip toward the bulb, provides a gripping action by the cap as it is forced over the neck and its elastic material stretched. The wiping and wetting that occurs during the application of the cap further assures a good seal between the cap and the neck. Thus, the small outward force on the cap is exceeded by the rather large frictional forces thereby leading to retention of the cap in place on the neck notwithstanding the pressure generated during the digestion.

The opening 34 is also sufficiently small to trap an air bubble immediately below the inside surface of the cap 4 during application of the cap. This erects a physical gas barrier which restricts physical contact between the contents of the ampule and the cap. This barrier is particularly advantageous when the ampule is used in a COD test since, as noted above, the reagents used in such tests are corrosive. In the absence of this barrier, an inversion/mixing process prior to digestion would allow direct exposure of the cap 4 to the reagents, which would compromise the test.

Moreover, the small aperture prevents accidental spills of the contents after opening the container.

The second ceramic band 22 is located at a portion of the neck that is of wider diameter than the portion of the neck at which the first ceramic band 4 is located. Thus, removal of the second detachable segment 18 provides an opening that is useful, for example, for transferring the contents of the ampule to another vessel for conducting a spectrophotometric test using a higher quality spectrophotometric cell. When the ampule is being used in a COD test, the wider aperture may also be used to gain access to the ampule for the purpose of running a titrimetric test on a digested sample.

In use, the manufacturer fills the ampule with the premixed, premeasured reagents specified by the U.S. EPA as appropriate for a particular COD test. Such reagents might include sulfuric acid and other highly corrosive chemicals. The manufacturer then flame seals the mouth of the ampule to ensure the total absence of leakage after manufacture, during transportation and subsequent storage, and through to final use by the customer. The elastomeric sheath is placed over the neck of the ampule, and it is then shipped to a user. After the user has collected a sample, he snaps off the first detachable segment. The user then adds a sample to the ampule, mixes, and reseals the ampule with the cap. The ampule is then heated in a digester block, the elastomeric cap preventing the release of internal pressure during the digestion process. The user mixes the ampule contents once more, and reads the resulting absorbance with a spectrophotometer to obtain an EPA-approved analytical determination of the Chemical Oxygen Demand (COD).

Modifications within the scope of the appended claims will be apparent to those of skill in the art.

We claim:

1. In combination, an ampule, a removable protective sheath, and a resealing cap, wherein said ampule comprises a container and an elongated neck, said neck being in open communication with said container and tapering to a tip of small diameter, said removable protective sheath covers a major portion of said neck for protecting said neck during shipment and is flexible enough to allow a portion of said tip to be snapped off to open said ampule, and said resealing cap comprises an elastic element for being slidingly placed over an open end of said neck and being retained on said neck by frictional forces, wherein said cap comprises an inner sealing cap and outer sleeve means for providing resistance to radial deformation of said inner sealing cap.

2. A combination according to claim 1 wherein said inner sealing cap is of silicone and said outer sleeve means is of a shape similar to that of said inner sealing cap and is made of a material more rigid than said silicone.

3. An ampule for use in performing a chemical test and cap means for resealing said ampule, said ampule comprising a container portion of optically clear material for containing reagents for use in said test and a neck portion in fluid communication with said container portion, said neck portion comprising a narrow elongate tip remote from said container portion and a bulbous section intermediate said tip and container portion, and said cap comprising an elastic element for being slid over said tip to seal said tip after a portion of said tip has been removed and being held to said neck solely by frictional forces between said element and said neck wherein said cap comprises an inner sealing cap and outer sleeve means for providing resistance to radial deformation of said inner sealing cap.

4. A combination according to claim 3 wherein said inner sealing cap is of silicone and said outer sleeve means is of a shape similar to that of said inner sealing means and is made of a material more rigid than said silicone.

5. In combination, an ampule, a removable protective sheath, and a resealing cap, wherein said ampule comprises a container and an elongated neck, said neck being in open communication with said container and tapering to a tip of small diameter, said removable protective sheath covers a major portion of said neck .for protecting said neck during shipment and is flexible enough to allow a portion of said tip to be snapped off to open said ampule, and said resealing cap comprises an elastic element for being slidingly placed over an open end of said neck after said tip had been snapped off and being retained on said neck by frictional forces wherein said protective sheath comprises a cylindrical section, a conical section, and a nipple extension, all in open communication with each other, wherein the nipple extension is of smaller diameter than the cylindrical sheath and is connected to the cylindrical sheath by the conical section.

6. A combination according to claim 5 wherein said neck includes a weakened portion to facilitate removal of said tip, the weakening of said weakened portion being provided by a ceramic band.

7. A combination according to claim 5 wherein said sheath is constructed of a transparent plastic material.

8. A combination according to claim 7 wherein said sheath is constructed of vinyl.

9. A combination according to claim 5 wherein said cap comprises an elastomeric silicone material.

10. A combination according to claim 5 wherein said ampule is constructed of optically transparent glass for direct spectrophotometric analysis of the contents of the ampule.

11. A combination according to claim 5 wherein the diameter of said tip is sufficiently small that when the ampule contains a liquid an air bubble will be trapped immediately below the inside surface of the cap during the emplacement of the cap.

12. A combination according to claim 5 wherein said neck has at least two constrictions along its length which are separated by at least one convex segment.

13. An ampule for use in performing a chemical test and cap means for resealing said ampule, said ampule comprising a container portion of optically clear material containing reagents for use in said test and a neck portion in fluid communication with said container portion, said neck portion comprising a narrow elongate tip remote from said container portion and a bulbous section intermediate said tip and container portion, and said cap comprising an elastic element for being slid over said tip to seal said tip after a portion of said tip has been removed and being held to said neck solely by frictional forces between said element and said neck wherein the diameter of said tip is small to produce a small opening after said portion of said tip has been removed, said opening being such that a bubble of air is trapped just below said cap when said cap is slid onto said neck, said reagents are for performing a spectrophotometric COD test, and said neck includes a first ceramic band at one end of said portion of said tip for facilitating removal of said portion.

14. A combination according to claim 13 wherein the outside diameter of the tip is about 2.5 mm, and the diameter of said opening is about 1.7 mm.

15. A combination according to claim 13 further comprising a second ceramic band for facilitating removal of a second portion of said neck, said second ceramic band being located at a part of said neck having a diameter larger than said diameter of said opening.

16. A combination according to claim 13 further comprising a removable protective sheath for covering the major portion of said neck and protecting said neck during shipment.

17. A combination according to claim 16 wherein said sheath comprises elastic vinyl and permits said portion of said tip to be snapped off and contained when said sheath covers said neck.

18. A combination according to claim 13 further comprising a removable protective sheath for covering the major portion of said neck, protecting said neck during shipment said sheath comprising elastic vinyl and permitting said portion of said tip and said second portion to be snapped off when said sheath covers said neck.

* * * * *